United States Patent [19]

Stadtmiller et al.

[11] Patent Number: 4,592,851

[45] Date of Patent: Jun. 3, 1986

[54] LUBRICATING OIL COMPOSITION AND METHOD FOR PROVIDING IMPROVED THERMAL STABILITY

[75] Inventors: William H. Stadtmiller, Colonia, N.J.; Kenneth G. Morris, Graniteville, S.C.

[73] Assignee: Exxon Research and Engineering Co., Florham Park, N.J.

[21] Appl. No.: 447,120

[22] Filed: Dec. 6, 1982

Related U.S. Application Data

[63] Continuation-in-part of Ser. No. 183,389, Sep. 2, 1980, abandoned.

[51] Int. Cl.[4] ..... C10M 125/22; C10M 125/24; C10M 129/91

[52] U.S. Cl. ..... 252/32.7 E

[58] Field of Search ..... 252/32.7 E

[56] References Cited

U.S. PATENT DOCUMENTS

| | | | |
|---|---|---|---|
| 2,202,877 | 6/1940 | Stevens et al. | 44/9 |
| 2,265,582 | 12/1941 | Stevens et al. | 260/624 |
| 2,739,122 | 3/1956 | Kennerly et al. | 252/32.7 E |
| 2,991,246 | 7/1961 | Kleinholz | 252/32.7 E |
| 3,032,502 | 5/1962 | Barnes et al. | 252/51.5 |
| 3,041,279 | 6/1962 | Calhoun et al. | 252/32.7 E |
| 3,112,269 | 11/1963 | Calhoun et al. | 252/32.7 E |
| 3,726,798 | 4/1973 | Silver | 252/32.7 E X |
| 3,929,654 | 12/1975 | Brewster et al. | 252/48.2 |
| 4,094,800 | 6/1978 | Warne | 252/32.7 E |
| 4,179,384 | 12/1979 | Mann | 252/32.7 E |

FOREIGN PATENT DOCUMENTS

| | | | |
|---|---|---|---|
| 1235896 | 6/1971 | United Kingdom | 252/32.7 E |

OTHER PUBLICATIONS

C. V. Smalheer and R. K. Smith, "Lubricant Additives," 1967, pp. 6–11.

Kirk-Othmer, "Encyclopedia of Chemical Technology," Second Edition, vol. 12, 1967, pp. 574–575.

*Primary Examiner*—William R. Dixon, Jr.

*Assistant Examiner*—Margaret B. Medley

*Attorney, Agent, or Firm*—Eugene Zagarella

[57] ABSTRACT

A high viscosity index lubricating oil with improved thermal stability, anticorrosion and antiwear properties and the method for providing such composition which contains a major amount of paraffinic mineral oil basestock and effective amounts of a combination of a basic zinc dialkyl dithiophosphate and 2,6 di-tertiary butyl phenol.

13 Claims, No Drawings

LUBRICATING OIL COMPOSITION AND METHOD FOR PROVIDING IMPROVED THERMAL STABILITY

CROSS-REFERENCE TO RELATED APPLICATIONS

This application is a continuation-in-part of Ser. No. 183,389 filed Sept. 2, 1980 now abandoned.

BACKGROUND OF THE INVENTION

This invention relates to a hydraulic lubricating oil composition and method for providing improved thermal stability properties. More particularly this invention is directed to a hydraulic lubricating oil composition of relatively high viscosity index (VI) with good antiwear, anticorrosion and thermal stability properties comprising a major amount of paraffinic mineral oil and a particular combination of a basic zinc dialkyl dithiophosphate and 2,6 di-tertiary butyl phenol.

The field of lubricants and lubricating oils has been extensively developed over the years. Because of the wide variety of applications and conditions a large number of different oil compositions with a plurality of additives have been developed and manufactured. However, because of the complexity of the properties associated with such lubricants and the relationship of the different components to one another, it is oftentimes difficult to develop suitable lubricant compositions for a particular application.

The use of metal dithiophosphates as antiwear additives and also as antioxidants in lubricating oils has long been known. Various antioxidants including phenolic compounds and particularly hindered phenols are also wellknown additives for lubricating oils as disclosed in "Lubricant Additives" by C. V. Smalheer and R. Kennedy Smith 1967, pp. 6–11; Kirk-Othmer "Encyclopedia of Chemical Technology," Second Edition, Vol. 12, 1967, pp. 574–575 and U.S. Pat. Nos. 2,202,877; 2,265,582; 3,032,502 and 3,929,654.

While the use of various compounds as antioxidants and antiwear additives in lubricating oils is known as previously indicated, nevertheless, it was difficult to develop a hydraulic oil composition having a paraffinic mineral oil basestock with high VI and with the requisite antiwear, anticorrosion and thermal stability properties.

SUMMARY OF THE INVENTION

In accordance with this invention, it was unexpectedly found that lubricating oil compositions comprising a major amount of paraffinic mineral oil of high VI and effective amounts of selected basic zinc dialkyl dithiophosphates and 2,6 di-tertiary butyl phenol had particularly improved thermal stability, antiwear and anticorrosion properties. This was particularly surprising, since other similar lubricating oils containing the same zinc dialkyl dithiophosphates with the commonly used and very similar hindered phenol, i.e., 2,6 di-tertiary-butyl-4 methyl phenol give inferior thermal stability and anti-corrosion properties.

This invention is particularly directed to a lubricating oil composition with improved thermal stability and anticorrosion properties comprising a major amount of a paraffinic mineral oil, from about 0.1 to about 1.5% by weight of a basic zinc dialkyl dithiophosphate having alkyl groups made from primary alcohols containing from about 4 to about 20 carbon atoms and from about 0.05 to about 1.0% by weight of 2,6 di-tertiary butyl phenol, said composition having a viscosity of about 4 to about 160 centistokes (cSt) at 40° C. and a viscosity index (VI) of from about 80 to about 115.

Another embodiment of this invention relates to a method for providing a hydraulic paraffinic mineral oil with improved thermal stability and anticorrosion properties comprising adding effective amounts of an additive combination of selected basic zinc dialkyl dithiophosphates and 2,6 di-tertiary butyl phenol.

DETAILED DESCRIPTION OF THE INVENTION

As previously indicated this invention involves a hydraulic lubricating oil comprising a major amount of paraffinic mineral oil and effective amounts of a combination of a basic zinc dialkyl dithiophosphate and 2,6 di-tertiary butyl phenol. This invention further involves a method for providing a hydraulic lubricating oil with improved thermal stability and anticorrosion properties by adding an effective amount of an additive combination of selected basic zinc dialkyl dithiophosphate and 2,6 di-tertiary butyl phenol.

The base oil used in the lubricating oil composition of this invention is generally a paraffinic mineral oil and is largely comprised of paraffin hydrocarbons, either straight or branched chain, and cycloparaffins or naphthene. While the amount of aromatics and polar constituents will be substantially lowered in processing the basestock, it is likely that lesser amounts of aromatic compounds and other components which are difficult to separate may remain along with the paraffinics and cycloparaffins. Typically, the aromatic content may be up to about 35% and more preferably up to about 25% by weight of the basestock material. It is therefore intended that the term "paraffinic mineral oil basestock" as used through this application, include such lesser amounts of aromatic and other components. The mineral oil basestock material is generally obtained from crude oil using conventional refining techniques which include one or more steps such as distillation, solvent extraction, hydrofining and dewaxing.

The paraffinic mineral base oil will generally be of such quality that the resulting lubrication composition will have a viscosity index (VI) of from about 80 to about 115, preferably about 90 to about 105, and a viscosity of about 4 to about 160, preferably about 20 to about 100 centistokes (cSt) at 40° C. The pour point of the resulting composition will generally be from about −20 to about 20° F.

The dithiophosphate component used in this invention will be a basic zinc dialkyl dithiophosphate having alkyl groups made from primary alcohols containing about 4 to about 20 carbon atoms. Generally the basic zinc dialkyl dithiophosphate will have a zinc to phosphorus ratio of about 1.15–1.65 to 1, preferably about 1.20–1.50 to 1.

The zinc dialkyl dithiophosphate are generally made from dialkyl dithiophosphoric acid having the formula:

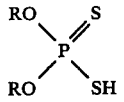

wherein R comprises an alkyl group containing about 4 to about 20, preferably about 6 to about 12 carbon atoms. The alkyl groups generally originate from primary alcohols including normal alcohols such as n-hexyl, n-heptyl, n-octyl, n-decyl, n-dodecyl and stearyl alcohol and branched chain alcohols such as methyl or ethyl branched isomers of the above. Suitable branched alcohols are 2-methyl-1-pentanol, 2-ethyl-1-hexahol, 2,2 dimethyl-1-octanol and alcohols prepared from olefin oligomers such as propylene dimer or trimer by hydroboration-oxidation or by the Oxo process. It may be desirable to use mixtures of alcohols because of their low cost and possible improvements in performance. "Lorol B" alcohol, a mixture consisting of alcohols in the $C_8$ to $C_{18}$ range as one such example.

The zinc dialkyl dithiophosphates are generally prepared by first reacting the alcohol with phosphorus pentasulfide ($P_2S_5$). The resulting dialkyl dithiophosphoric acid is then reacted with zinc oxide or zinc hydroxide to form the basic zinc dialkyl dithiophosphate. By basic is meant an excess of zinc oxide or hydroxide over what is needed to stoichiometrically neutralize the acid. As previously noted, the basic material will have a zinc to phosphorus ratio of about 1.15–1.65 to 1, preferably about 1.20–1.50 to 1.

The zinc dialkyl dithiophosphates as used in this invention can be prepared by batch or continuous process. Further information about such compounds and the method of preparation can be found in U.S. Pat. No. 4,094,800.

The other essential ingredient used in this invention in combination with the basic zinc dialkyl dithiophosphate is 2,6 di-tertiary butyl phenol. It is particularly important that the para position remain open since a similar type compound, 2,6 di-tertiary butyl para cresol, which has a methyl group in the para position gave unsatisfactory results when used in the lubricating oil composition of this invention.

The paraffinic mineral oil base oil will be used in the lubricating oil composition in a major amount i.e., about 80% or more preferably about 90% or more by weight based on the total weight of the composition. The basic zinc dialkyl dithiophosphate component will be used in amounts of from about 0.1 to about 1.5% by weight and preferably about 0.2 to about 1.0% by weight. The 2,6 di-tertiary butyl phenol component will be used in amounts of from about 0.05 to about 1.0% by weight and preferably about 0.1 to about 0.5% by weight.

The hydraulic lubricating oil of this invention can also contain other conventional type additives such as an antifoamant, pour point depressants, demulsifiers, rust inhibitors, etc., which are typically used in lubricating compositions. Generally, such additives are used in relatively small amounts with the total amount of additives being usually less than 20% and more usually less than 10% by weight.

One useful additive is an anti-rust compound and more particularly a nonacid lubricating oil anti-rust compound which is the reaction product of an alkenyl succinic anhydride and an alcohol or amine or mixtures thereof. By nonacidic is meant those anti-rust compounds which do not have an appreciable number of free acid groups and generally have a neutralization number of less than about 100 as determined by ASTM D-974. The hydrocarbyl substituent of the succinic anhydride can be saturated or unsaturated, branched or unbranched and will be of such a nature that the final nonacidic anti-rust compound is oil soluble. The oil soluble hydrocarbyls can be of relatively low molecular weight such as those having about 6 to 60 carbon atoms. Generally, succinic acids of up to about 50 carbon atoms are the most effective rust inhibitors. Preferably the hydrocarbyl group will contain about 8 to about 50, more preferably about 10 to about 20 carbon atoms. The alcohols used in preparing the nonacidic anti-rust compound commonly contain about 2 to about 30 and preferably from about 4 to about 20 carbon atoms. Such alcohols may be monoalcohols or polyols, e.g., ethanol, dodecanol, propylene glycol, glycerol, etc. The amines which can be used in preparing the nonacidic anti-rust compound commonly contain about 2 to about 30, preferably about 4 to about 20 carbon atoms. These amines can be mono or polyamines, primary or secondary, branched or unbranched and may contain unsaturation. Examples of some useful amines include ethyl amine, dipropyl amine, isobutyl amine, cyclohexyl amine, benzyl amine etc. Such anti-rust additives will generally be used in amounts of from about 0.02 to about 1.0% by weight and preferably from about 0.02 to about 0.1% by weight. Further details about anti-rust compounds of this type can be found in U.S. Pat. No. 4,094,800.

The following examples are set forth to illustrate the invention and should not be construed as a limitation thereof.

EXAMPLE I

A hydraulic lubricating oil was prepared having a major amount of paraffinic mineral oil solvent 330N base stock (viscosity 330 SUS at 100° F.), 0.45% by weight of basic zinc dialkyl dithiophosphate with the alkyl groups having 8 carbon atoms and 0.2% by weight of 2,6 di-tertiary butyl phenol. The composition also contained a wax naphthalene pour depressant, a methacrylate polymer antifoamant, a naphthalene sulfonate soap demulsifier and an alkenyl succinic acid derivative rust inhibitor. The resulting composition had a VI of 95–100 and a pour point of 15° F.

The composition was tested for thermal stability and anticorrosion properties using a test procedure developed by Cincinnati Milacron Company. The test procedure utilizes two clean weighed rods of 0.25 inch diameter and three inches long, one of 99.9 percent copper and the other one 1.0 percent carbon steel. The rods are submerged in 200 cc of the test oil in contact with each other and the oil is heated to 135° C. After 168 hours at 135° C., the rods are removed from the oil and loose sludge is squeezed back into the oil. At this point the copper rod is visually evaluated and rated as to stain and discoloration by ASTM D-130 rating scale.

The copper rod is washed with acetone to remove oil before being weighed to determine the total weight of the rod.

The total volume of test oil is then evaluated for sludge in accordance with the Cincinnati Milacron test procedure. In this procedure the total amount of oil is filtered through a preweighed No. 31 Whatman filter paper. The remaining residue found in the beaker is washed with naphtha onto the filter paper. The residue on the filter paper is washed with naphtha until all evidence of oil is removed from the residue. The residue and filter paper is air dried and then weighed. The weight of residue from 200 ml. of oil is determined by subtracting the original weight of filter paper from the weight of paper and residue. This weight is noted in the results below as sludge weight in mg/100 ml.

The results obtained from this composition were copper corrosion (ASTM) 2C, copper rod weight change mg. −0.2 and sludge, mg./100 ml. 0.1.

For comparison purposes, the same composition having 0.20% by weight of 2.6 di-tertiary butyl para cresol substituted for the 2,6 di-tertiary butyl phenol was tested in the same manner and found to have copper corrosion of 4C (black flaky corrosion), copper rod weight change mg. −27.6 and sludge, mg./100 ml. 3.0. It is quite significant that the comparative composition had poor stability properties as compared to the composition of this invention which contained 2,6 di-tertiary butyl phenol in combination with basic zinc dialkyl dithiophosphate.

EXAMPLE 2

Another sample of lubricating oil using a similar prepared composition as Example 1 with the base-stock material and the basic zinc dialkyl dithiophosphate components being obtained from different manufacturing batches was tested as in Example 1.

The results of the thermal stability were copper corrosion 1A, copper weight change mg. −1.0 and sludge, mg./100 ml. 0.45.

A similar composition but having 2,6 di-tertiary butyl para cresol instead of the 2,6 di-tertiary butyl phenol gave a copper corrosion of 4A (black flaky corrosion copper weight change mg. 4.6 and sludge mg./100 ml. 0.35. The comparative sample failed the test on black flaky copper corrosion deposit and the results are quite clearly poor in comparison to the composition of this invention.

The above results show the significantly improved and unexpected thermal stability results when using the composition of this invention which contains basic zinc dialkyl dithiophosphate and 2,6 di-tertiary butyl phenol.

EXAMPLE 3

A lubricating oil composition prepared as in Example 1 but containing 0.2% by weight of a number of different phenol compounds, as identified below, was tested for thermal stability and anticorrosion properties as described above.

The results shown in Table 1 indicate that the combination of 2,6 di-teritary butyl phenol and basic zinc dialkyl dithiophosphate in a lubricating oil has significantly better thermal stability and copper corrosion properties than compositions which contain other phenolic antioxidants. As noted in the results, the compositions B through F all had corrosion of 4C (black flaky corrosion) as compared to only moderate tarnish for composition A which contained 2,6 di-tertiary butyl phenol. Also compositions B through F all had significantly higher copper rod weight change and sludge deposit than composition A.

TABLE 1

Evaluation of Test Compositions in Termal Stability Test

| Test Composition (phenolic compound used) | Copper Rod Rating[1] | Copper Rod Wt. Change (mg) | Sludge Wt. mg/100 ml. |
|---|---|---|---|
| A (2, 6 di-tert butyl phenol) | 2C | −0.2 | 0.85 |
| B (2, 6 di-tert butyl-para-cresol) | 4C | +4.4 | 1.80 |
| C (2, 6 di-tert butyl-4-ethyl phenol) | 4C | −7.0 | 1.75 |
| D (2, 6 di-tert butyl-4-n-butyl phenol) | 4C | +0.5 | 6.00 |
| E (4, 4'-methylene bis (2, 6 di-tert butyl phenol)) | 4C | +3.3 | 3.00 |
| F 1, 6-hexamethylene bis (3, 5 di-tert butyl, 4 hydroxy hydrocinnamate) | 4C | +1.8 | 4.65 |

[1]As rated by ASTM D 130; 2C is moderate tarnish, 4C is corrosion, In examples B through F, there were black flakes corroding off the copper specimen.

EXAMPLE 4

For comparison purposes, lubricating oils similar to that prepared in Example 1, but containing a number of different commercially available non-basic zinc dialkyl dithiophosphates (i.e. had zinc to phosphorus ratios of less than 1.15) were tested and compared with lubricating oils containing a basic zinc component for thermal stability and anticorrosion properties as described above.

The results shown in Table 2 indicate that the combination of basic zinc dialkyl dithiophosphate with 2,6 di-tertiary butyl phenol in lubricating oils (Oils A and B) has significantly better thermal stability and copper corrosion properties than compositions which contain a nonbasic zinc dialkyl dithiophosphate (oils C to E). As noted in the results, the compositions C through E all had corrosion of 4B (flaky corrosion) as compared to only moderate tarnish (ratings 2D and 2A) for compositions A and B which contained basic zinc dialkyl dithiophosphate. Also, compositions C through E all had significantly higher copper rod weight change and sludge deposit than compositions A and B.

These results clearly evidence the improved and unexpected thermal stability results obtained in a lubricating oil which contains the combination of basic zinc dialkyl dithiophosphate and 2,6 di-tertiary butyl phenol as compared to lubricating oils containing a non-basic zinc in combination with the 2,6 di-tertiary butyl phenol.

TABLE 2

| Test Composition | ZDDP[1] Component (Zinc/Phosphorus) | Copper Rod Rating[2] | Copper Rod Wt. Change (mg) | Sludge Wt. mg/100 ml. |
|---|---|---|---|---|
| A | Basic (1.23) | 2D | −0.2 | 1.3 |
| B | Basic (1.22) | 2A | −0.5 | 0.7 |
| C | Non-basic (1.05) | 4B | −15.1 | 145.6 |
| D | Non-basic (1.07) | 4B | −21.6 | 15.9 |
| E | Non-basic (1.07) | 4B | −54.4 | 183.4 |

[1]ZDDP-zinc dialkyl dithiophosphate
[2]As rated by ASTM D130, 2A and 2D is moderate tarnish, 4B is corrosion, in Examples C through E there were flakes corroding off the copper specimen.

What is claimed is:

1. A lubricating oil composition with improved thermal stability and anti-corrosion properties comprising a major amount of paraffinic mineral oil, from about 0.1 to about 1.5% by weight of a basic zinc dialkyl dithiophosphate having alkyl groups made from primary alcohols containing from about 4 to about 20 carbon atoms and a zinc to phosphorus ratio of about 1.15–1.65 to 1 and from about 0.05 to about 1.0% by weight of 2,6 di-tertiary butyl phenol, said composition having a viscosity of about 4 to about 160 cSt at 40° C. and a VI of from about 80 to about 115.

2. The composition of claim 1 wherein said alkyl groups in said dialkyl dithiophosphates have from about 6 to about 12 carbon atoms.

3. The composition of claim 2 containing from about 0.1 to about 0.5% by weight of 2,6 di-tertiary butyl phenol.

4. The composition of claim 3 containing from about 0.2 to about 1.0% by weight of basic zinc dialkyl dithiophosphate.

5. The composition of claim 4 wherein said composition contains at least about 80% by weight of said paraffinic mineral oil and has a viscosity of about 20 to about 100 cSt and a VI of from about 90 to about 105.

6. The composition of claim 5 wherein said basic zinc dialkyl dithiophosphate has a zinc to phosphorus ratio of about 1.20–1.50 to 1.

7. The composition of claim 6 which contains from about 0.02 to about 1.0% by weight of a nonacid lubricant anti-rust compound comprising the reaction product of a succinic anhydride substituted with an alkenyl group of from about 8 to about 50 carbon atoms and an alcohol, an amine or mixtures thereof.

8. The composition of claim 7 wherein said composition contains at least 90% by weight of said paraffinic mineral oil.

9. In the method of lubricating a hydraulic system using a hydraulic lubricating oil the improvement comprising providing improved thermal stability and anticorrosion properties by using a lubricating oil which contains a major amount of paraffinic mineral oil basestock and a combination of from about 0.1 to about 1.5% by weight of a basic zinc dialkyl dithiophosphate having alkyl groups made from primary alcohols containing from about 4 to about 20 carbon atoms and a zinc to phosphorus ratio of about 1.15–1.65 to 1 and from about 0.05 to about 1.0% by weight of 2,6 di-tertiary butyl phenol.

10. The method of claim 9 wherein said alkyl groups in said dialkyl dithiophosphate have from about 6 to about 12 carbon atoms.

11. The method of claim 10 wherein from about 0.1 to about 0.5% by weight of 2,6 di-tertiary butyl phenol and from about 0.2 to about 1.0% by basic zinc dialkyl dithiophosphate is used.

12. The method of claim 11 wherein said composition has a viscosity of about 4 to about 160 cSt at 40° C. and a VI of from about 80 to about 115.

13. The method of claim 12 wherein said composition contains at least about 80% by weight of said paraffinic mineral oil and said basic zinc dialkyl dithiophosphate has a zinc to phosphorous ratio of about 1.20–1.50 to 1.

* * * * *